United States Patent [19]

Toepke

[11] 4,086,088

[45] Apr. 25, 1978

[54] IMAGING METHODS FOR USE WITH CHARGED PARTICLE MODULATOR DEVICE

[75] Inventor: Ival Lee Toepke, Newbury, Ohio

[73] Assignee: Addressograph Multigraph Corporation, Cleveland, Ohio

[21] Appl. No.: 670,345

[22] Filed: Mar. 25, 1976

[51] Int. Cl.[2] ..... G03G 13/24

[52] U.S. Cl. ..... 96/1 R; 355/3 R; 250/315 R; 346/153; 346/159

[58] Field of Search ..... 96/1 R; 355/3 SC; 346/74 ES, 74 EB, 74 P; 250/315 R, 315 A

[56] References Cited

U.S. PATENT DOCUMENTS

| | | | |
|---|---|---|---|
| 3,457,070 | 7/1969 | Watanabe et al. | 96/1 R X |
| 3,680,954 | 8/1972 | Frank | 96/1 R X |
| 3,694,200 | 9/1972 | Pressman | 96/1 R |
| 3,713,734 | 1/1973 | Crane et al. | 355/3 SC |
| 3,879,195 | 4/1975 | Fotland | 96/1 R |
| 3,898,085 | 8/1975 | Suzuki et al. | 355/3 SC X |
| 3,942,980 | 3/1976 | Hou | 96/1 R X |
| 3,980,474 | 9/1976 | Jackson | 96/1 R |
| 3,986,871 | 10/1976 | Blades et al. | 96/1 R |
| 4,022,527 | 5/1977 | Jackson | 96/1 R X |
| 4,022,528 | 5/1977 | Jackson | 96/1 R X |

*Primary Examiner*—Roland E. Martin, Jr.
*Attorney, Agent, or Firm*—Sol L. Goldstein

[57] ABSTRACT

The improved modulator of this invention is constructed by sandwiching a metal screen between a photoconductive layer and an insulating layer which permits processing of the multi-layered element by directing all processing steps against the photoconductive surface so as to provide separate and distinct fringing fields across the insulating layer which correspond to the image and non-image portions of the subject matter to be reproduced. The processing steps call for first applying a blanket DC electrostatic charge from a DC biased corona, followed by the application of a DC charge, from a DC biased corona, which is opposite in polarity to the charge applied in the first step, and a third step in which the entire member is flood illuminated to place the photoconductive layer in a conductive state.

14 Claims, 4 Drawing Figures

IMAGING METHODS FOR USE WITH CHARGED PARTICLE MODULATOR DEVICE

BACKGROUND OF THE INVENTION

The present invention relates generally to the field of electrophotographic imaging techniques, and, more particularly, is directed to the use of a multi-layered photoresponsive foraminated structure which is capable of having stored thereon a charge pattern corresponding to the light and dark areas of a graphic original.

The construction and use of such photoconductive screens, generally known in this art as modulators, is well developed. The patent literature describes in great detail modulators which consist of two layers, namely the metal screen overcoated with a photoconductive material, as well as three- and four-layered modulators which include as separate layers, in addition to the photoconductor and the metal screen, insulating layers and other metal layers.

It has been known to impart different properties to modulators by varying the number and kind of layers that make up the screen as well as their position relative to one another in the make-up of the modulator. Two-layered screens, for example, made up of a metal screen and a photoconductor, are known to sustain a charge pattern for a brief period permitting limited repetitive use. The ability of such modulators to sustain a charge pattern is due to the dipole charge created across the photoconductive layer. This charge pattern, or charge distribution system as it is known in this art, can endure for a sufficient length of time, usually several minutes, permitting some repetitive use. Significant improvement in the properties of the member to retain the charge distribution system was achieved by the addition of a transparent insulating layer applied over the photoconductive layer. Such an arrangement permitted the creation of the charge distribution system on the surface of the insulating layer which was not affected by radiation and the resulting leakage to ground through a conductive contact. It has also been found that by changing the sequence of certain processing steps or by carrying out these steps simultaneously, surprising properties are imparted to the modulator such as dual dipole fields on the same modulator which correspond to the image and non-image areas on the graphic original.

All of the foregoing advancements in the art, which gave the unique results, were completely unpredictable and unsuspecting.

The modulator art still suffers from deficiencies because of the requirement to specially position one surface of the modulator when creating the charge distribution system on the modulator on the one hand and move it to expose a different surface when it is used for imaging the receiving sheet. Previously known structures required separate charge particle generating apparatus and illumination sources to be juxtaposed different faces of the modulator in order to permit its use in a reproduction system. This tends to complicate the apparatus calling for duplicate instrumentalities to be associated with the modulator for certain of the processing steps. In the circumstance that the modulator is moved with respect to these instrumentalities, it then requires additional apparatus to move the modulator so that the proper surface confronts the particular instrumentality.

Such prior art systems and modulators are fully described in U.S. Patent application Ser. No. 552,184 filed Feb. 24, 1975 in the name of Houshang Rasekhi and assigned to the same assignee as this invention.

SUMMARY OF THE INVENTION

The modulator construction of this invention and the improved imaging process calls for positioning the metal screen between a photoconductive layer and an insulating layer in a three-layered structure . Thus, the insulating layer is in direct surface contact with the metal while the photoconductive layer is separated from the insulating layer by the conductive foraminated structure. This specific arrangement permits all of the processing steps, including the final steps of projecting charged particles through the modulator, to take place from the photoconductor side. The charge distribution system is created on the insulating surface, which is remote from the corona charging units and the illumination sources so that their charge distribution system persists indefinitely on the insulating layer. Further, the processing steps are such that the charge distribution system is comprised of dual dipole fields corresponding to the image and non-image areas of the graphic subject matter to be reproduced.

The first step in the process calls for the application of a charge to the photoconductive surface which is applied from a controlled voltage source. Such a controlled voltage source is achieved by using a DC biased AC corona which in practice applies an AC field across the emission electrodes. The application of such an AC field across such emission electrodes would not extract the generated ions until an appropriate DC source is applied as a bias to the output side of the transformer in order to create the appropriate field to cause the ions to move in the direction of the target, which in this case would be the surface of the modulator. For the purposes of this invention, such a biased corona will be referred to as a DC biased corona source. This combination is one way of providing a controlled voltage source because it avoids the problem of charging up the receiving medium to a level beyond the potential of the DC bias itself. It is desirable in applying the sensitizing charge to the modulator of this invention in this first step to maximize the current flow to the surface and achieve a uniform charge thereon to a predetermined level in as short a time as possible. Conventional DC corona sources, to achieve these results, must be at a very high potential, which means there is a large electric field between the corona and the surface and the efficiency of such a system in terms of the percentage of total current generated that reaches the surface of the target is rather poor. Much of the current goes to the shield, which is required to generate the corona plasma. The details of the construction of a DC biased corona source of the type employed in this invention will be discussed in greater detail hereinafter.

In the practice of this invention, it is necessary that the photoconductor have certain bichargeable characteristics such as described in the aforementioned U.S. application, Ser. No. 552,184 filed in the name of Houshang Rasekhi. Because of its bichargeable property, the photoconductor is capable of accepting both positive and negative electrostatic charges. The DC biased corona source, in the first step, will direct charges onto the dark adapted photoconductive surface of a particular polarity. The photoconductive surface will accumulate a charge of such polarity to a predetermined level. Due to the electrical field pattern created by the charges deposited on the surface of the photoconductive layer, the charge emitted from the electrodes are funneled through the apertures of the modulator and collected on the insulating surface on the face of the modulator opposite to the conductive layer. It will be appreciated that this first step must be carried out by protecting the photoconductive layer from exposure to electromagnetic radiation. Hence, during the first step, charges of the same polarity will collect both on the photoconductive surface and on the insulating surface of the modulator. At each of the interfaces between the photoconductive layer and the metal, and the insulating layer and the metal layer, there will be induced an array of oppositely poled charges which are bound at each of the interfaces by the existing charges on the surfaces.

The term electromagnetic radiation as it is used in the description of this invention shall mean radiation having wave lengths in the ultra-violet, visible, infra-red and x-ray portions of the spectrum.

In the second processing step, which is the imaging step, the photoconductive surface is applied a pattern of light and shadow simultaneous with the application of a charge from a DC biased corona source. It will be appreciated that the same corona source can be used in step I with the exception that the polarity of the DC input to the transformer is reversed. In those portions of the photoconductive layer which are exposed to the electromagnetic radiation produced by the pattern of light and shadow, the photoconductive layer is rendered conductive and charges move through the layer neutralizing the opposite charges at the interface. In the dark portions of the modulator, the positive charges on the surface are neutralized by the negative charges from the DC biased source. The time duration of the imaging step not only neutralizes the charges on the surface of the photoconductor but also charges up the photoconductor in the dark to the opposite polarity of step I and causes the funneling of the charges through the openings in the modulator so that they accumulate on the insulating layer neutralizing the oppositely poled charges collected on that surface. Therefore, portions of the modulator which correspond to the dark portions of the graphic subject matter from which the pattern of light and shadow is projected undergo a reversal in polarity from what was imparted in the first step. An array of charges oppositely poled to what was applied in step I are on the surface of the photoconductor and the metal layer and the boundary between the insulator and the metal layer are likewise oppositely poled.

After the second step, the modulator has dipole fields established across the photoconductive layer and the insulating layer in the dark portions, and in the light struck portions a dipole field has been created across the insulating layer but it is oppositely poled to what is present in the dark portions of the modulator.

In the third and final step whereby a charge distribution system (CDS) is created, the modulator is given a blanket exposure to electromagnetic radiation so that the photoconductive layer is placed in a conductive state causing all of the charges accumulated therein to bleed off to ground leaving the modulator to have the dual dipole fields which are opposite in polarity across the light and dark portions of the modulator at the insulating layer.

It is the general object of this invention to provide an improved imaging process for rapidly making high contrast reproductions of graphic originals using a three-layered modulator with one of the layers being an insulating layer on which has been captured dual dipole fields associated therewith for controlling the passage of charged particles through the image and non-image areas.

It is an object of this invention to provide a simplified process for rapidly making high contrast reproductions of graphic originals through the use of a modulator in which all of the processing steps can be carried out relative to one surface of the modulator to impart to it a charge distribution system which will persist for long periods of time.

It is another object of this invention to provide an improved modulator-controlled imaging system for making high contrast reproductions of graphic subject matter capable of controlling the passage therethrough of charged particles operating in conjunction with an electrode system and which provides a high degree of flexibility as to the type of image which may be produced from either positive or negative type graphic originals by reversing the polarities of the charged particles.

It is a specific object of this invention to provide an improved imaging system for making high contrast reproductions of a graphic original in which an ion modulator is used with an ion projecting electrode system capable of projecting ions through the modulator at sufficiently high rate to be deposited on a collecting medium to produce high density images in rapid succession.

It is a further object of this invention to provide an improved imaging system for making high contrast reproductions of graphic originals using a modulator containing separate and co-existing electric fields created across the insulating layer, which electrical fields have been photoelectrically produced so that charged particles are selectively transmitted through the modulator at a rapid rate to produce high density images in a relatively short period of time.

It is another specific object of this invention to provide an improved reproduction apparatus capable of making high contrast multiple reproductions of a graphic original utilizing a modulator having imposed across its various apertures separate co-existing electric fields corresponding to the image and non-image areas and which modulator may be employed by having all processing steps directed at one surface of the modulator which simplifies the apparatus construction.

Other objects and features of this invention, particularly the parameters for each of the processing steps as they may be applied in the reproduction field of art, will become apparent to those skilled in this art from the following detailed description.

DETAILED DESCRIPTION OF THE INVENTION

Figure 1:
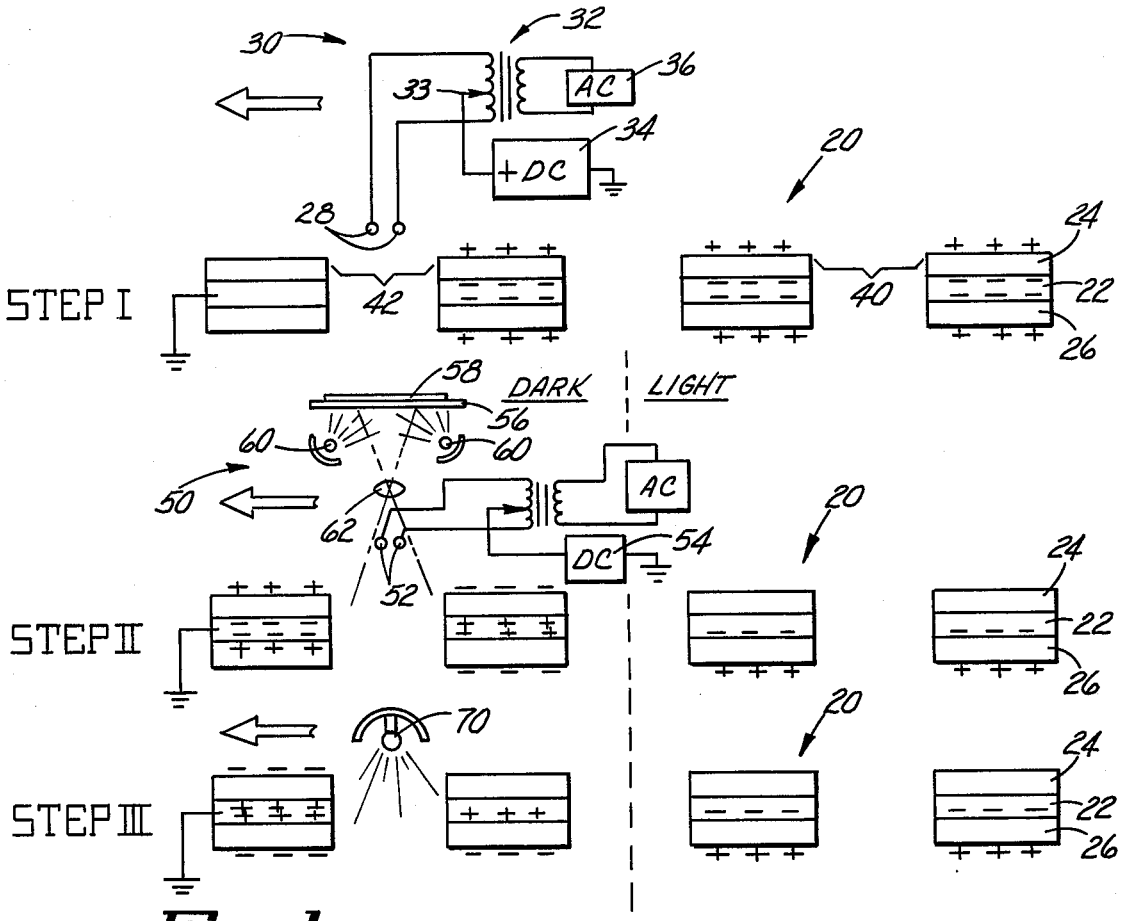
FIG. 1 is a schematic representation illustrating the steps necessary to create the dual dipole electrical fields on the insulating surface of the modulator.

Referring to FIG. 1, there is depicted three steps that comprise the novel process for producing a charge distribution system (CDS) on a modulator which is generally identified as 20. The modulator 20 is made up of three separate layers, all being firmly bonded together, the center being the conductive layer 22 which is a wire mesh screen formed of a material such as stainless steel, copper, brass, aluminum or steel wire. The use of metals readily satisfies the conductivity requirements for this middle layer 22. Other conductive or semiconductive materials may be used provided their discharge relaxation time is less than the time duration of the processing steps.

Against one surface of the conductive layer is applied the photoconductive layer 24 which must possess certain bichargeable characteristics in order that the modulator accept and retain the dual dipole fields thereon. The significance and applicability of such bichargeable properties to the photoconductor are dealt with in the specification disclosure of U.S. patent application Ser. No. 552,184 filed in the name of Houshang Rasekhi and assigned to the same assignee as this invention.

The reference to the property of bichargeability refers to the characteristic of the photoconductor to accept both a positive or negative charge. The term "bichargeable" as it is used in the environment of this invention to describe a property of the photoconductive layer means that the photoconductive layer exhibits a blocking junction relative to the conductive substrate so that under conditions where it is dark adapted, it blocks charge particles of both polarities.

A wide range of photoconductive materials may be utilized to form the layer 24 in order to meet such bichargeable properties. Selenium is representative of the class of elemental photoconductors. Selenium works well. Inorganic photoconductors formed of metal ion-containing crystalline compounds such as zinc oxide are also usable.

Organic photoconductors have been found to have utility in the modulators of this invention and typical of the organic photoconductive materials are the following compounds:

- polyvinyl carbazole (U.S. Pat. No. 3,037,861)
- polyvinyl benzocarbazole (U.S. Pat. No. 3,751,246)
- polyvinyl iodo benzocarbazole (U.S. Pat. No. 3,764,316)
- poly acryloyl carbazole
- poly acryloyl benzocarbazole
- poly acryloyl iodo benzocarbazole
- N-substituted polyacrylic acid amines (U.S. Pat. No. 3,037,940)

To be added to the above list of organic photoconductors are those which are monomeric, that is, require being dispersed in a carrier or resin binder to be applied to the screen. These are as follows:

- phenyl oxazolone (U.S. Pat. No. 3,257,203)
- triaryl alkanes (U.S. Pat. No. 3,542,544)
- triaryl amines (U.S. Pat. No. 3,542,548)
- phenyl-pyrazoline (U.S. Pat. No. 3,180,729)
- alknyl amino phenyl substituted amino thiodiazoles (U.S. Pat. No. 3,161,505)
- diaryl amines and triaryl amines (U.S. Pat. No. 3,141,770)

In using all of the aforementioned photoconductive materials, whether they be elemental, inorganic, or organic, will require further treatment in order to increase their photoresponse. These treatments generally involve the use of a number of additives, depending on the type of photoconductive material that is employed in order to achieve such extension of the photoresponse. Usually, the materials are responsive in the ultra-violet range and are extended into the visible range by the use of dyes, various inorganic materials in the case of selenium and, in the case of organic photoconductors, $\pi$ acid acceptors.

The preferred acceptors to be used with the aforementioned organic photoconductors are the fluorenone compounds such as 2, 4, 7, tri-nitrofluorenone; dicyanomethylene substituted fluorenones described in U.S. Pat. No. 3,752,668 to Evan S. Baltazzi; the bianthrones described in U.S. Pat. No. 3,615,411 to William J. Hessel; and oxazalone and butenolide derivatives of fluorenone, described in U.S. Pat. No. 3,556,785 to Evan S. Baltazzi. It has been found the type of acceptor employed can influence the bichargeable properties of the photoconductive materials.

Referring again to FIG. 1 and continuing with the description of the modulator construction, the organic photoconductive layer 24 can range in thickness from 3 microns to 50 microns, depending on the nature of the photoconductive material and the screen mesh size. The useful thickness, when using organic photoconductors, may range from 3 to 10 microns. It has been found that in the case of selenium the usable range of thickness is from 5 to 40 microns. In the case of inorganic photoconductors such as zinc oxide, the operable range is from 10 to 50 microns. It should be pointed out that the thickness of the layer 24 is not critical. However, it is important to apply the photoconductor with a sufficient degree of consistency and uniformity so as to completely and uniformly cover the conductive screen 22.

To the other surface of the screen 22 is applied the insulating layer 26. This layer is required to have a discharge relaxation time substantially greater than the time required to utilize the modulator in a reproduction process. A resistivity value greater than $10^{15}$ ohm-centimeters is required for this layer in order that it possess the proper relaxation time constant. A number of resins may be used for the layer 26 such as: polystyrene, polyester, polypropylene, polycarbonate acrylic vinyl epoxy, polyethylene terephthalate and polyfluoride. The resins may be applied from a solvent solution by spraying the screen structure or otherwise coating the structure with a solution in order to provide a uniform thickness of the insulating material onto the conductive surface 22. The insulating layer 26 must be firmly bonded and is required to make complete contact with the metal surface in order to operate effectively. The general procedures for fabricating such modulators will be described in greater detail hereinafter.

In the first step shown in FIG. 1, the modulator 20 formed of layers 22, 24 and 26 is applied a charge from corona emission electrodes 28 which are connected to a power supply 30.

The power supply is a controlled voltage source. The electrodes 28 are connected to the output terminals of a voltage transformer 32. The center tap 33 of the output side of the transformer is connected to a high voltage DC source 34. The input to the transformer 32 is connected to an AC source 36. The regulated DC supply 34 attached to the center tap 33 of the transformer 32 provides the necessary electrical field to pull the correct polarity ions from the corona plasma generated in the vicinity of the electrodes 28 to the surface of the photoconductive layer 24. The high voltage DC source 34 supplies a bias voltage in the range of from 200 to 8,000 volts. The AC source 36 is connected to the input side of the transformer. The voltage which is applied to the AC source will depend on the turns ratio of the transformer. In the instant invention, a turns ratio of 100:1 was used and, therefore, the input side of the transformer is in the range of from 50 to 70 volts.

As shown in step I of FIG. 1, the electrodes 28 are adapted to traverse the surface of the photoconductive layer 24 in the direction of the arrow so as to apply a blanket electrostatic charge thereto. The polarity of the charge, as described earlier, may be either positive or negative. In step I of FIG. 1, a positively poled charge is applied to the surface.

It will be appreciated that the photoconductive layer 24 is dark adapted and the application of the charge in step 1 is carried out under conditions where the modulator is protected from exposure to electromagnetic radiation. As shown in the drawings, the DC bias is positively poled thereby applying a positive charge to the surface of the photoconductive layer. The deposition of positive charges on the surface of the photoconductive layer will cause an array of negative charges to be induced from the grounded conductive layer 22 at the interface between the layers 24 and 22. The array of negative charges are bound at this interface. The continued emission of positive charges from the electrodes 28 will be in the direction of the apertures 40 and 42. As the positive charges move into the aperture, they will proceed through the aperture and into the general atmosphere and be attracted to the insulating layer 26, producing a charge on the surface thereof. The deposition of the positive charges on the insulating layer 26 in this manner will also induce at the interface between the insulating layer 26 and the metal layer 22 a corresponding charge of opposite polarity thereby forming a dipole field across the insulating layer.

It will be appreciated that optionally an additional electrode may be employed in the first step such as a plate electrode connected to a DC source to create an electrical field whereby the positive ion particles which pass through the apertures 40 and 42 are directed toward the layer 26. Such a plate electrode (not shown) would be about one centimeter distance from the surface of the layer 26 and be connected to a DC source that generates a field in the range of from 50 volts to 5,000 volts in such an electrode. The polarity of the DC source should be the same polarity as the charges applied to the photoconductive layer 24. The positively charged particles which pass through the apertures 40 and 42 are directed towards the surface of the layer by the positive field generated from such a plate electrode, which will increase the charge accumulation on the surface of the layer 26.

In any case, whether or not an additional electrode is employed, the metal layer 22 is connected to ground.

In step II of the process, the modulator 20 is exposed to a pattern of light and shadow from an imaging source 50 simultaneous with the application of a DC charge from DC biased corona electrodes 52 connected to a DC supply 54. The imaging source 50 is comprised of a transparent platen 56 on which is placed a graphic original 58 with the side containing the graphic subject matter thereon face down against the glass platen 56. A pair of electromagnetic radiation sources 60 positioned immediately underneath the transparent glass platen direct electromagnetic radiation against the surface of the original to produce a pattern of light and shadow which is then transmitted through a lens 62 to the photoconductive surface 24 of the modulator simultaneous with the application of a charge from a charging assembly which is the same in structure as used in step I, with the exception that the polarity of the DC bias is reversed.

As the imaging source 50 moves across the surface of the modulator 20, the charges from the DC biased corona source will tend to erase, neutralize and reverse the positive charges thereon from the previous charging step. The light struck portions of the photoconductive layer 24 will become conductive causing the particles to move through the photoconductive layer and neutralize the charges bound at the interface. With the removal of the charge on the surface of the photoconductive layer 24, the oppositely poled charges bound at the interface between the metal layer 22 and the photoconductive layer 24 are dissipated. The dipole field across the insulating layer 26 obtains in the portion of the modulator which corresponds to the light struck areas of the pattern of light and shadow. The modulator in the dark zones, corresponding to the shadow portions of the pattern of light and shadow projected by the imaging source 50, experiences a reversal of polarity on the surface of the photoconductive layer due to the action of the DC biased corona emitter. Accordingly, in the dark zones of step II as the imaging source traverses the modulator, the surface of the layer 24 becomes negatively charged as a result of the positive charges having been neutralized, and at the interface between the layers 24 and 22 produces a positive charge. In the dark zone, the negative charges are funneled through the apertures and neutralize the positive charges on the insulator established from step I so that the surface of the insulator now becomes negatively charged and there is bound at the interface between the insulator and the conductive metal layer an equal positive level of charges. At the end of the second step in the light zones corresponding to the light portions of the pattern of light and shadow the modulator 20 will have a dipole charge across the insulating surface 26 having positive charges on its surface. In the dark zones corresponding to the shadow portions of the projected pattern of light and shadow, it will have negative charges on the surface of the photoconductor and on the surface of the insulator. What has been achieved at the end of step II is that the modulator 20 has dual dipole fields in the light and dark areas respectively across the insulating layer 26. However, there remains a dipole field across the photoconductive layer 24.

In the third step of the process, there is provided a source of electromagnetic radiation 70 which sweeps across the modulator so as to render the photoconductive layer in a conductive state as a result of such illumination. Portions of the modulator 20 having been illuminated as a result of the imaging process in step II are in a conductive state, and those portions which were protected from irradiation by the shadow portions are now struck by light so that they, too, become conductive. This causes the remaining negative charges on the surface of the photoconductor to move through the layer and neutralize the positive charges bound at the interface between the layers 22 and 24. This removes the dipole field from across the photoconductive layer 24 corresponding to the shadow portions of the projected light pattern.

Figure 2:
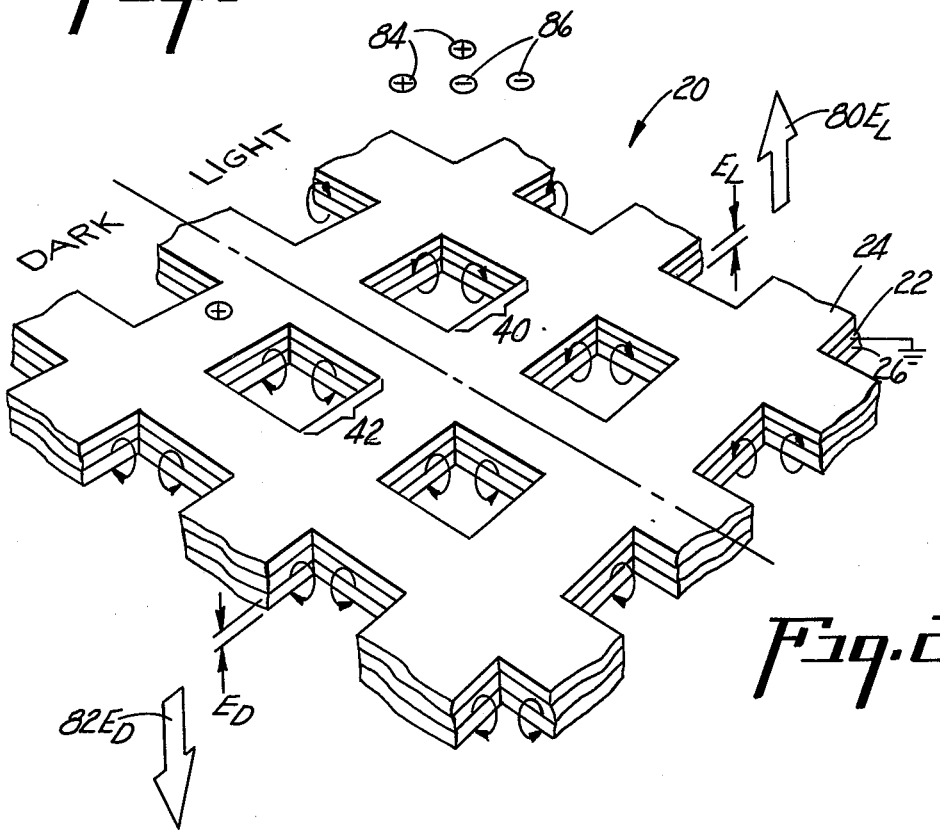
FIG. 2 is a perspective view of the modulator showing schematically the direction and location of the dipole fields produced on the modulator.

Referring now to FIG. 2, there is shown the modulator 20 having created thereon a CDS having dipole fields respectively in the light and dark zones across the insulating layer 26. In the light struck zones, the field across the insulator $E_L$ is shown as emanating from the positive charges on the surface of the insulating layer and moving in the direction of the negative charges bound at the interface. The direction of the field $E_L$ occurring at the apertures 40 is directed upwardly as shown by the arrow 80 $E_L$. In the dark zone, the field is across the insulating layer 26 emanating from the interface between the insulator and the photoconductor and terminating at the insulator surface. The field direction $E_D$ occurring at the apertures 42 in the dark zones is directed downwardly as shown by the arrow 82.

One of the significant advantages of the instant invention is the utilization of the modulator for the purpose of creating an image on a receiving member in the same position relative to the instrumentalities which created the CDS thereon without having to relocate or move it so as to present a different surface during the particle projection step. Accordingly, the modulator 20 of FIG. 2 is now ready to create a developable charge pattern on a receiving sheet. The projection of gas ions may be directed against the side of the modulator having the photoconductive layer thereon.

In the practice of this invention, the modulator 20, with the CDS therein, will function in a manner so that charge particles or gas ions which are presented to the apertures 40 and 42 will be either blocked or funneled through said aperture by the action respectively of the fields $E_D$ and $E_L$. Taking advantage of one of the important features of this invention, charged particles or gas ions 84 can be directed towards the same layer as when creating the CDS. In this case, it is the photoconductive layer 24. A positive gas ion which enters the aperture 40 in which the field $E_L$ is counter-current to the movement of the positive particle will cause the particle to be attracted to the conductive layer 22 thereby having a blocking effect.

The same positive particle 84, when it comes under the influence of the aperture 42, will be funneled through to be collected onto a suitable collecting medium. The funneling effect results by virtue of the co-current relationship of the movement of the particle and the direction of the field causes the positive particle to be repelled by the field and propelled through the aperture.

If we now consider the movement of negatively charged gas ions 86 being directed to the apertures 40 and 42 corresponding to the light and dark zones respectively, they will be propelled through the apertures 40 and blocked in the apertures 42. Negative particles which move counter-current to the direction of the field $E_L$ will experience a propelling effect while the same negative particle under the influence of the field $E_D$ in the aperture 42 will be blocked by being attracted to the metal layer 22.

It will be appreciated that the projection of gas ions may be accomplished by using electrodes connected to a positively poled or negatively poled direct current source or otherwise a balanced AC source, the former projecting either positive or negative ions and the latter both positive and negative particles. The last case in which both negative and positive particles are projected against the modulator creates the unique condition of dual dipole fields across the surface of the insulator which selectively block the positive particles but funnel negative particles in the apertures 40, block the passage of the negative particles in the apertures 42, but funnel the positive particles.

It will be seen that the projection of charge particles from corona emission electrodes powered by an AC source directed against the photoconductive layer 24 of the modulator 20 will pass positive particles through the dark zones 42 and negative particles through the light zones 40. As described hereinabove, by means of a suitable collection electrode system, it is possible to provide a dielectric paper on which the particles passing through the modulator would be collected, thereafter to be developed into a material image. In the description of the operation of the modulator in FIG. 2, ions transmitted by the aperture 40 will correspond to light reflective or light transmitted surfaces of the graphic original. The ions transmitted by the apertures 42 will correspond to the dark or shadow portions of the graphic original. It is possible to obtain a positive reproduction from a positive original by developing the system with negatively charged toner particles. If a reverse image is to be reproduced, then it is only necessary to reverse the polarity. One will readily recognize that if the graphic original is a silver halide transparency in which the transparent portions thereof represent the image to be viewed, then it is only necessary to use toner having a polarity opposite to the charges collected in the light zones of the modulator.

In order to use the modulator with a CDS thereon as an imaging device by the virtue of its capability of discriminating charged particles from passing through its apertures, it is necessary to place it in an environment which is likened to a grid system in a triode vacuum tube.

Figure 3:
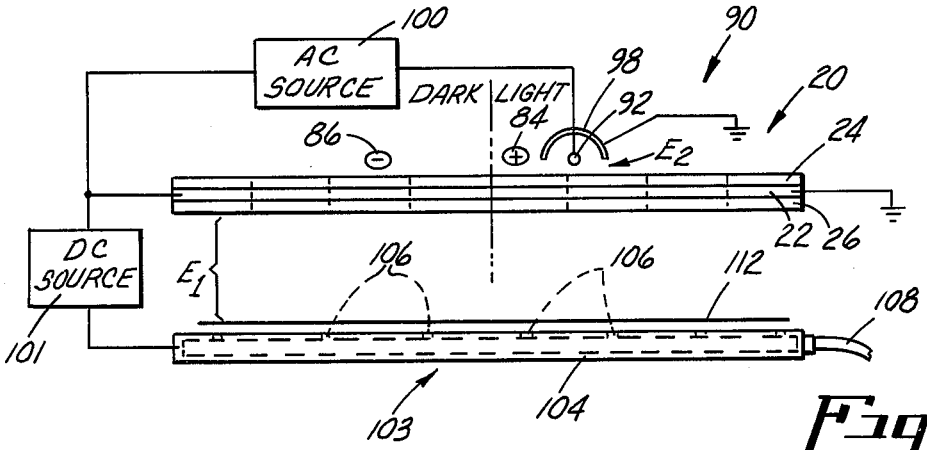
FIG. 3 is a schematic representation of the system of electrodes and their arrangement for generating and collecting the charged particles through the modulator.

Referring now to FIG. 3, there is shown an ion projection assembly 90 comprised of an emission electrode 92 which projects gas ions towards the photoconductive layer 24 of the modulator 20. The electrode 92 is a corona wire surrounded by a conductive shield 98 connected to ground. The electrode 92 is connected to one terminal of an AC source 100. The other terminal of the AC source is connected in parallel to the conductive layer 22 and the collecting electrode 103 through the DC source 101. Between the conductive layer 22 and the electrode 103 is a DC power supply 101 which creates the field $E_1$. The collecting electrode 103 consists of hollow plate member 104 which is equipped with openings 106 on one surface thereof to permit the influx of air to the interior of the plate and having an outlet connection 108 which leads to a vacuum pump (not shown) for exhausting the air from the electrode 103 so as to cause a pressure differential between the atmosphere and the surface thereof. The electrode 103 is disposed in the projection assembly so that is lies in a plane parallel to the plane of the modulator 20 and facing the insulating layer 26 thereof.

The receiving sheet 112, which may be a sheet or web of suitable material, such as dielectric paper, plastic film, or cloth, is placed on the surface of the plate 104 in contact with and covering the openings 106 creating a pressure differential at the surfaces of the plate causing the paper 112 to be brought into pressure contact with the electrode 103. As the negative particles 86 or positive particles 84 are funneled through the modulator 20 by the modulating action of the apertures 40 and 42, they come under the influence of the collection field $E_1$ which can be in the range of 500 to 12,000 volts per centimeter which causes them to be propelled and directed to the collecting electrode 103 and to be attracted to the paper 112 in a pattern which conforms to the CDS of the modulator 20 and corresponding to the pattern of the graphic original to be reproduced. Upon completion of the collection of ions on the paper 112, it is removed from the electrode assembly and the visible image is developed by conventional developing techniques using electroscopic powder.

The potential applied to the emission electrode is in the range of 3,000 to 12,000 volts. This creates an electrical field between the electrode and the surface of the modulator in the range of 1,000 to 3,000 volts per centimeter. The projection assembly as described in FIG. 3, wherein the modulator is exposed to both positive and negative charges, will produce the same pattern as was described in connection with FIG. 2.

Figure 4:
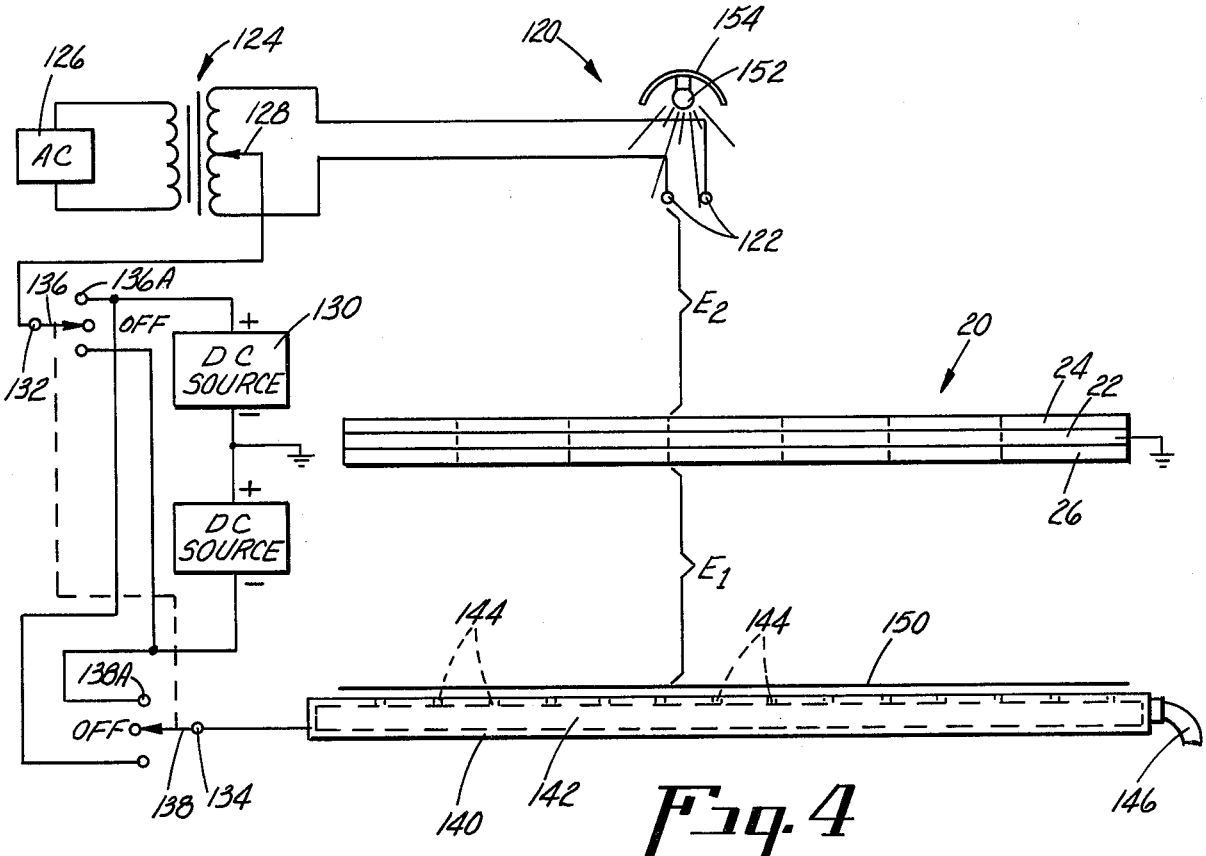
FIG. 4 is a schematic of an alternate technique of utilizing the modulator to produce a charge pattern on a collecting medium.

In another embodiment the modulator 20 may be utilized in an electrode projection system using a controlled voltage source as shown in FIG. 4. Referring to FIG. 4 of the drawings, there is shown an electrode assembly 120 capable of projecting gas ions onto the surface of the modulator 20. The electrode assembly 120 includes a pair of fine wire electrodes 122 which are connected to the output terminals of the voltage transformer 124. The input to the transformer 124 is connected to an AC source 126. The center tap 128 of the output side of the transformer leads to a DC source 130 operating through switches 132 and 134 equipped respectively with operators 136 and 138. The switches 132 and 134 can connect the center tap 128 to the positive side of the DC source 130 by moving the operator 136 to the 136A contact, which simultaneously causes the operator 138 to move to the contact 138A, connecting the collecting electrode 140 to the negative side of the DC source 130.

The electrode 140 is similar in its construction to the electrode 104 shown in FIG. 3. The electrode 140 consists of a hollow plate member 142 which is equipped with openings 144 on one surface thereof to permit the influx of air to the interior of the plate and having an outlet connection 146 which leads to a vacuum pump (not shown) for exhausting the air from the electrode 140 so as to cause a pressure differential between the atmosphere and the surface thereof. The electrode 140 is disposed in the projection assembly so that it lies in a plane parallel to the plane of the modulator 20 and facing the insulating layer 26 thereof.

The receiving sheet 150, which may be a sheet or web of suitable material as described earlier, is placed on the surface of the member 142 in contact with and covering the openings 144 thereby creating a pressure differential at the surface of the electrodes causing the paper 150 to be brought into intimate contact with the electrode 140.

It is important to observe that part of the projecting electrode 120 is a radiation source 152 housed in a suitable reflector 154 so as to direct electromagnetic radiation, such as the radiation from an incandescent source, onto the modulator 20.

It will readily be appreciated that the electrode assembly 120 is capable of projecting either positively or negatively charged gas ions depending on the positioning of the operators 136 and 138. The emission from the electrodes 122 establishes a field $E_2$ between the wire and the layer 24. With the operator connected to the contact 136A and 138A, the wire electrodes 122 will emit positive gas ions. The emission of such positive gas ions will pass through the modulator 20 having a CDS as described in connection with FIG. 2. The particles will come under the influence of the field $E_1$ so that the positive gas will collect in the areas on the sheet 150 corresponding to the dark zones of the graphic subject matter to be reproduced. Development with electroscopic powder having negatively charged toner particles will be attracted to the positively charged areas on the sheet 150 to give a right reading or positive image corresponding to the dark areas of the graphic original.

Simultaneous with the emission of gas ions, the modulator 20 is exposed to electromagnetic radiation of the type generated by an incandescent lamp for the purpose of keeping the photoconductive layer 24 in a conductive state so that its surface is free of any charge accumulation so as to prevent setting up any competing fringing fields along the edges of the apertures across the photoconductive layer 24.

It will readily be observed that the ion generating assembly of FIG. 4 and the assembly 30 shown in FIG. 1 are similar in construction in that a regulated DC supply is connected to the center tap 128 of the transformer to provide a greater efficiency of corona current flow between the electrodes and the modulator and which is also more uniform than the normal DC corona source. In order to generate such high corona currents, the voltage on the wire electrodes must be in the range of 5,000 to 10,000 KV. This, in turn, provides a very large electrical field $E_2$ between the corona and the surface of the modulator.

In the circumstance where the field $E_2$ is desirably decreased by extending the distance between the electrodes and the modulator, less than about 10% of the current output of the electrodes reach the surface of the modulator for the reason that the largest percentage of the current goes to the shield to generate the corona plasma. In this invention, the center tap-high voltage transformer is used to provide the high voltage and the currents necessary to generate the corona plasma instead of the expensive and inefficient regulated DC supply. The regulated DC supply is attached to the center tap of the transformer in order to provide the electrical field necessary to pull the correct polarity ions from the corona plasma to the surface of the modulator. More than 50% of the current from the DC supply arrives at the modulator surface.

In summation, the novel modulator of the instant invention is capable of having established thereon dual dipole fields so as to give high contrast reproduction. It can be utilized without changing its position relative to the charging and imaging electrodes which created a CDS thereon and to modulate gas ions emitted during the ion projection step whereby the gas ions are utilized to create a charge image on a dielectric sheet. Finally, through the use of an AC charging assembly which is equipped with a DC bias control, more rapid processing of the modulator both in creating the CDS, as well as creating the charge pattern during the ion projection step, is made possible.

What is claimed is:

1. The method of producing a charge distribution system corresponding to the graphic subject matter of a graphic original on a modulator structure formed by an electrically conductive screen sandwiched between a photoconductive top layer and an electrically insulating layer having a resistivity greater than $10^{15}$ ohm centimeters, said photoconductive layer when dark adapted having a blocking junction relative the conductive substrate blocking the passage of charge particles, comprising the steps of:

applying a uniform electrostatic charge of a first polarity to said photoconductive top layer;

applying the surface of said photoconductive top layer with DC charges of such a magnitude and oppositely poled to the charges of said first polarity simultaneous with the projection of a pattern of light and shadow produced from illuminating said graphic original producing dark and light exposed zones on said modulator rendering the photoconductive layer conductive in the light exposed zones and reversing the charges in the dark zones creating charge patterns on the photoconductive layer and on the insulating layer;

flood irradiation of the top photoconductive layer with electromagnetic radiation of the type to which the photoconductive layer is responsive;

whereby said charge distribution system is created on the insulating layer comprised of charges of one polarity in the dark zones and oppositely poled charges in the light zones.

2. The method as claimed in claim 1 wherein said modulator is disposed in an electrode system comprising an emission electrode and a collecting electrode wherein charged particles emitted from said emission electrode are directed against said photoconductive layer and said collecting electrode is juxtaposed said insulating layer.

3. The method as claimed in claim 1 wherein said charge distribution system is comprised of potential gradients between the insulating layer and the conductive layer in said dark and light zones respectively as represented by oppositely poled voltages on said insulating layer.

4. The method as claimed in claim 1 wherein said photoconductive layer is comprised of a photoconductive medium having bichargeable properties.

5. The method as claimed in claim 1 wherein said photoconductive layer is comprised of an organic photoconductive component.

6. The method as claimed in claim 1 wherein said charged particles are gas ions.

7. The method as claimed in claim 2 wherein said charged particles are colored toner particles.

8. The method of making a reproduction of a graphic original by collecting charged particles on a dielectric medium through the use of a modulator structure formed by an electrically conductive screen sandwiched between a photoconductive top layer and an electrically insulating layer having a resistivity greater than $10^{15}$ ohm centimeters, said photoconductive layer under dark adapted conditions forming a blocking junction relative said conductive screen which blocks the passage of charge particles, comprising the steps of:

applying a uniform electrostatic charge of a first polarity to said photoconductive top layer;

applying the surface of said photoconductive top layer with DC charges of such a magnitude and oppositely poled to the charges of said first polarity simultaneous with the projection of a pattern of light and shadow produced from illuminating said graphic original producing dark and light exposed zones on said modulator rendering the photoconductive layer conductive in the light exposed zones and reversing the charges in the light zones creating charge patterns on the photoconductive layer and the insulating layer;

flood irradiation of the top photoconductive layer with electromagnetic radiation of the type to which the photoconductive layer is responsive rendering said zones to be either blocking or transmissive of charged particles;

directing said charged particles from a particle emission source against the photoconductive layer of said modulator; and collecting those particles transmitted by said modulator onto said dielectric medium.

9. The method as claimed in claim 8 wherein the particle emission source is a DC powered corona producing essentially a charge pattern of one polarity on said collecting medium.

10. The method as claimed in claim 8 wherein the particle emission source is a balanced AC powered corona.

11. The method as claimed in claim 8 wherein said modulator is disposed in a plane parallel to said charged particle emission source and there is provided a collecting electrode adjacent the insulating layer on which is retained said dielectric medium.

12. The method as claimed in claim 8 wherein said graphic original is positive reading and a positive reproduction is produced from said graphic original.

13. The method as claimed in claim 8 wherein said photoconductive layer is comprised of a photoconductive medium having bichargeable properties.

14. The method as claimed in claim 8 wherein said photoconductive layer is comprised of an organic photoconductive component.

* * * * *